US007056157B2

(12) United States Patent
Herring et al.

(10) Patent No.: US 7,056,157 B2
(45) Date of Patent: Jun. 6, 2006

(54) ADAPTER FOR DATA TRANSMISSION SYSTEMS

(75) Inventors: Nathaniel L. Herring, Norwich, CT (US); John J. Milner, Milford, CT (US); Rudolph A. Montgelas, West Hartford, CT (US)

(73) Assignee: Hubbell Incorporated, Orange, CT (US)

( * ) Notice: Subject to any disclaimer, the term of this patent is extended or adjusted under 35 U.S.C. 154(b) by 890 days.

(21) Appl. No.: 09/836,346

(22) Filed: Apr. 18, 2001

(65) Prior Publication Data

US 2002/0137393 A1 Sep. 26, 2002

Related U.S. Application Data

(62) Division of application No. 09/578,694, filed on May 26, 2000, now abandoned.

(51) Int. Cl.
*H01R 13/64* (2006.01)

(52) U.S. Cl. ..... 439/680

(58) Field of Classification Search ..... 439/533, 439/638, 536, 680, 957, 557, 676
See application file for complete search history.

(56) References Cited

U.S. PATENT DOCUMENTS

| | | | | | |
|---|---|---|---|---|---|
| 4,261,633 | A | | 4/1981 | Abernethy | |
| 4,268,109 | A | * | 5/1981 | Hardesty | 439/638 |
| 4,362,905 | A | | 12/1982 | Ismail | |
| 4,806,117 | A | | 2/1989 | Johnston | |
| 4,878,848 | A | | 11/1989 | Ingalsbe | 439/76 |
| 5,118,312 | A | | 6/1992 | Lu | 439/676 |
| 5,244,402 | A | | 9/1993 | Pasterchick, Jr. et al. | 439/217 |
| 5,593,323 | A | | 1/1997 | Dernehl | 439/668 |
| 5,599,206 | A | | 2/1997 | Slack et al. | |
| 5,647,043 | A | | 7/1997 | Anderson et al. | |
| 5,897,395 | A | | 4/1999 | Arnett | |
| 6,379,052 | B1 | * | 4/2002 | De Jong et al. | 385/39 |

* cited by examiner

*Primary Examiner*—Jean F. Duverne
(74) *Attorney, Agent, or Firm*—Jeffrey J. Howell; Alfred N. Goodman

(57) ABSTRACT

An adapter for a data transmission or communication system, has a body with a longitudinal axis. Longitudinal ends of the body define coaxial openings. One plug is receivable in one opening. Another plug is receivable in the other opening in at least two positions angularly offset relative to one another about the longitudinal axis of the body. Placement of the other plug in the different positions results in a polarity reversal of the system.

19 Claims, 7 Drawing Sheets

ADAPTER FOR DATA TRANSMISSION SYSTEMS

RELATED APPLICATIONS

This application is a divisional of co-pending U.S. patent application Ser. No. 09/578,694 to Nathaniel L. Herring et al., filed on May 26, 2000 now abandoned, the subject matter of which is hereby incorporated by reference.

FIELD OF THE INVENTION

The present invention relates to adapters for communication and data transmission systems that releasably engage a faceplate of an enclosure device. The adapters couple plugs or connectors for modifying existing faceplates used for various communication and data transmission systems. The adapters are particularly useful for MT-RJ and SC connections. Additionally, the MT-RJ adapter may reverse the polarity of the data transmission system.

BACKGROUND OF THE INVENTION

Many conventional communications and data transmission systems have a two optical fiber configuration, with one fiber sending information and the other fiber receiving information. A connector in this system would match the send and receive fibers in a male plug with the send and receive fibers in a female plug, respectively. The female plug may either have female receiving portions at opposite ends, allowing two male portions (each of which is coupled to a transmission line or cable) to be coupled into each female receiving portion. Alternatively, the female plug may have one female receiving portion at one end, with the other end coupled directly to a transmission line or cable.

Conventional connectors, such as MT-RJ jacks or SC connectors, can be coupled directly to 110-style outlet faceplates. An MT-RJ connection is generally a male/female style connection, with the female portion coupled to a faceplate. An SC connection generally has a connector coupled to a faceplate and engages two cables, with one cable at either end of the connector. These connectors typically make use of the readily available 110-style outlet faceplate, but do not necessarily couple to other style faceplates.

By using either style connection, the system is limited to the polarity with which it is wired. If the system is wired improperly or it is noted that the fibers for sending and receiving information in the female member do not match the send and receive fibers in the male jack, the fibers must be removed from either the male or the female parts and rewired. This rewiring complicates a field installation, adding time and expense.

U.S. Pat. No. 5,118,312 to Lu discloses an electrical connector configured with the female portion of the connector receiving the male portion of the connector in either an upright or inverted position. The electrical contacts from the male portion engage one of two sets of electrical contacts in the female portion. Each set of contacts is wired to the same transmission line, thus allowing the male portion to be inserted in the female portion in either position with the same result. The disadvantage of this electrical connector is that it must be wired in a similar manner to conventional phone or data jacks, using copper wire and metal contacts. The inversion of the male portion has no effect on the polarity of the system. If a wiring problem occurs, both contacts would be inoperative and inverting the male portion would not overcome this problem.

U.S. Pat. No. 5,593,323 to Dernehl discloses an electrical system using remote adapters that can reverse the polarity of the electrical current in the system. This polarity reversal allows a system to run a device that can perform two functions, such heating and cooling, depending on the polarity of the current supplied to the device. However, this type of polarity reversal has never been applied to communication or data transmission devices and only applies to a closed electrical circuit Examples of other prior art communication connectors are disclosed in U.S. Pat. Nos. 4,362,905 to Ismail, U.S. Pat. No. 4,878,848 to Ingalsbe, and U.S. Pat. No. 5,244,402 to Pasterchick, Jr. et al.

Thus, a continuing need exists to provide improved communication and data transmission adapters.

SUMMARY OF THE INVENTION

Accordingly, an object of the present invention is to provide an adapter for a communication system that can be coupled to an aperture in a faceplate, such as a keystone envelope, and improves the versatility of the system.

Another object of the present invention is to provide an adapter for a communication system that enables a connector to be plugged in at least two different orientations, reversing the polarity of the system which can reduce installation time and expense.

Still another object of the present invention is to provide an adapter for a communication system that enables a male plug to be inserted into each end of the adapter, reducing installation time and expense.

The foregoing objects are basically attained by providing an adapter for a communication system, comprising a body having a longitudinal axis, a first longitudinal end of the body defining a first opening therein, and a second longitudinal end of the body defining a second opening therein coaxial to the first opening. A first plug is receivable in the first opening. A second plug is receivable in the second opening in at least a first position and a second position, the first position being angularly offset relative to the second position about the longitudinal axis of the body.

By forming the adapter in the manner, placement of the second plug in the second position results in a polarity reversal of the system relative to placement of the second plug in the first position. Such alternative placement can avoid rewiring for correction of a wiring problem.

Other objects, advantages and salient features of the invention will become apparent from the following detailed description, which, taken in conjunction with the annexed drawings, discloses preferred embodiments of the invention.

As used in this application, up, down, upper and lower refer to relative directions depending on the orientation of the adapter in a faceplate, and do not limit the adapter to any specific orientation.

BRIEF DESCRIPTION OF THE DRAWINGS

Referring to the drawings which form a part of this disclosure.

DETAILED DESCRIPTION OF THE PREFERRED EMBODIMENT

Figure 1:
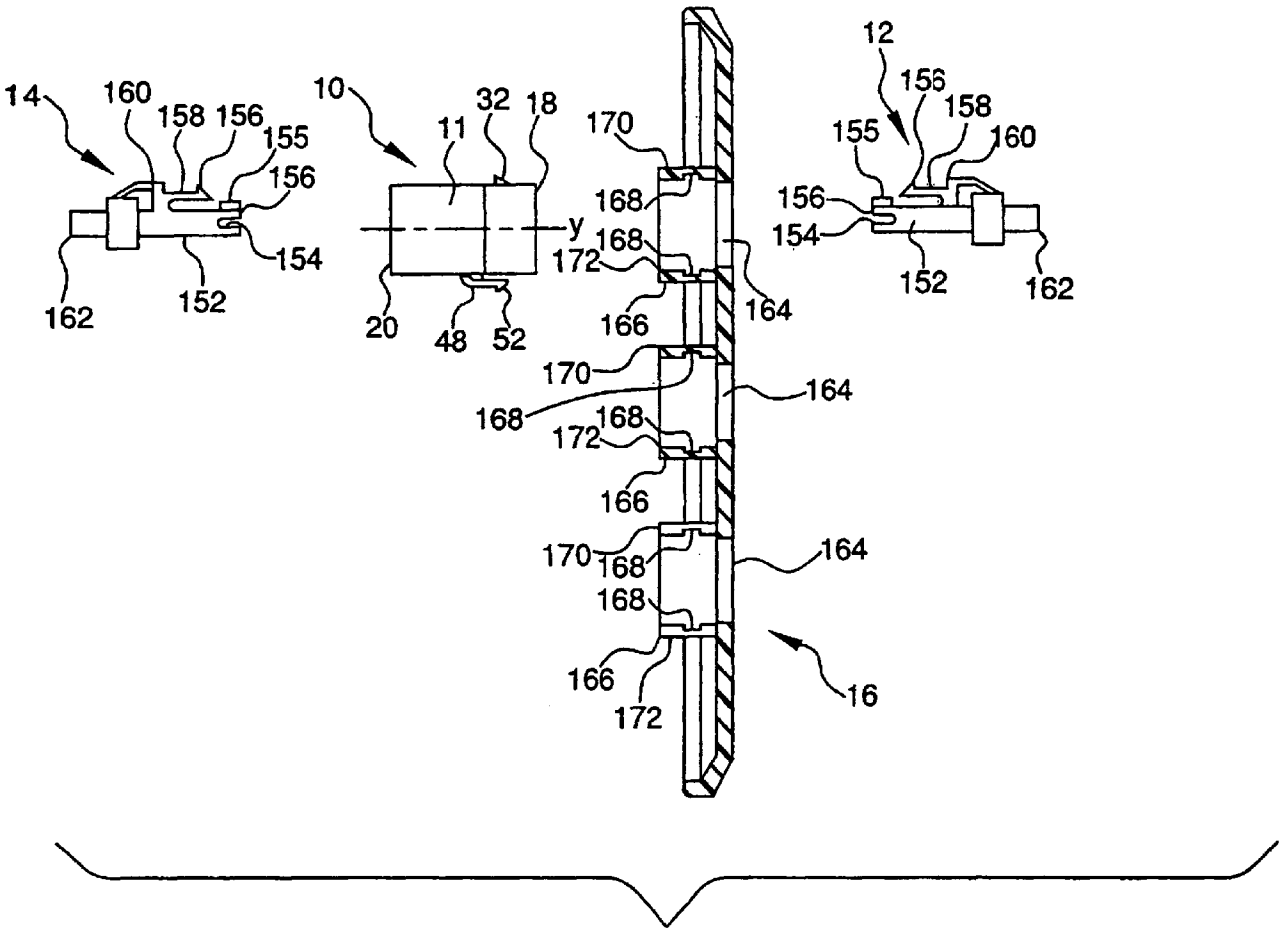
FIG. 1 is an exploded side elevational view of an adapter according to a first embodiment of the present invention, prior to engagement with a faceplate and two connectors.
Figure 2:
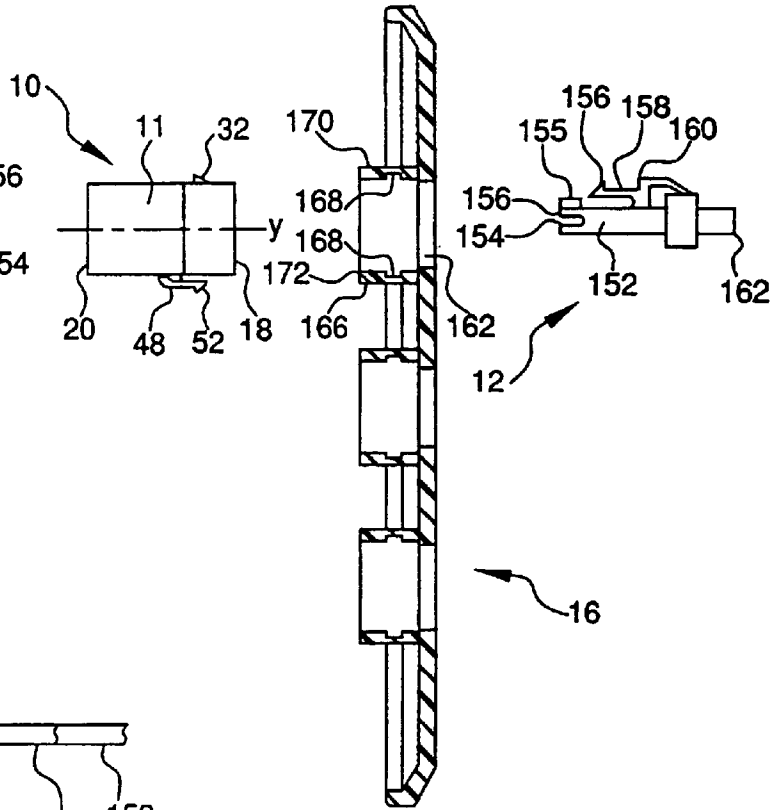
FIG. 2 is an exploded side elevational view of the adapter in FIG. 1, with one of the connectors shown in a second orientation.
Figure 3:
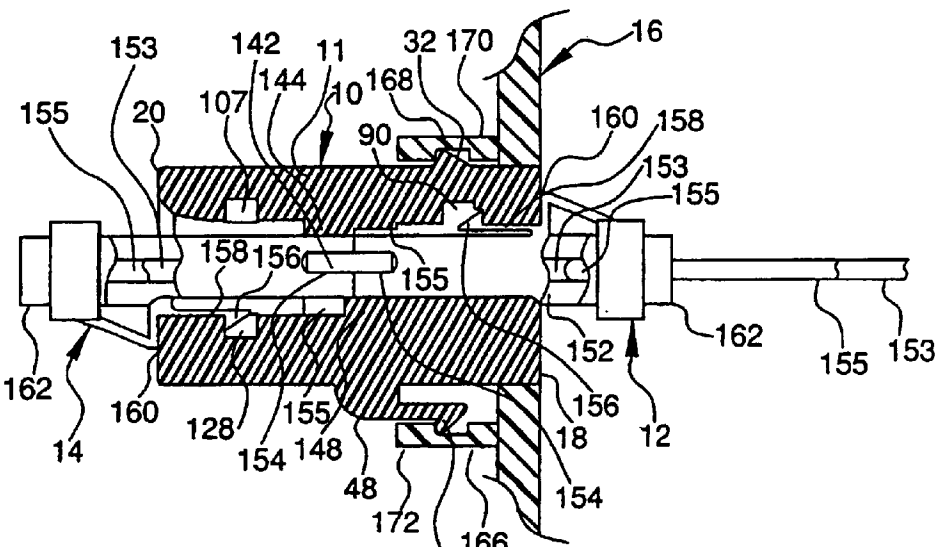
FIG. 3 is an enlarged side elevational view in section of the adapter of FIG. 2 engaging the faceplate and the two connectors.

Referring initially to FIGS. 1–3, an adapter or connector 10 according to a first embodiment of the present invention is shown with plugs or jacks 12 and 14 that may be inserted into each end of adapter 10. A faceplate 16 receives adapter 10 with plugs 12 and 14.

Adapter 10 is preferably molded from plastic, and has a substantially rectangular outer cross section, as seen in FIGS. 6–9. However, adapter 10 may be any suitable material and shape, as long as the adapter dimensions allow the adapter to be received by the desired faceplate. Adapter 10 includes a body 11 having a longitudinal axis y, a first open end 18, a second open end 20 coaxial to first open end 18, and a through passageway 21 extending through the body and connecting open ends 18 and 20. Adapter 10 also has exterior sides 22, 24, 26, and 28.

Figure 4:
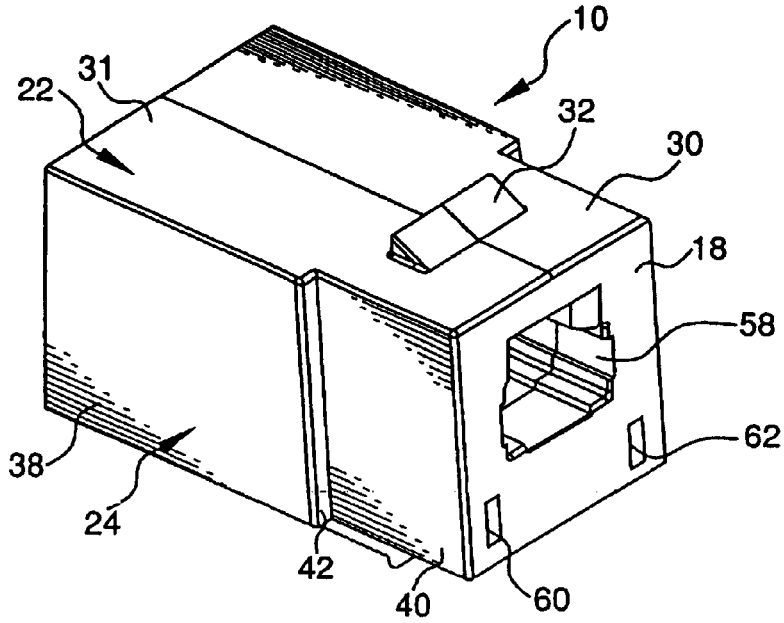
FIG. 4 is a top perspective view of the adapter of FIG. 2.

Side 22 is a substantially flat planar surface, divided into two sections 30 and 31. Section 30 is substantially rectangular and adjacent first end 18, and has an integrally formed protrusion or notch 32 extending therefrom that is about one-half the width of section 30, as seen in FIGS. 4–8. Protrusion 32 is defined by a surface 34 that extends outwardly and substantially perpendicularly from section 30 and a surface 36 that is adjacent surface 34 and extends from section 30 at an acute included angle, preferably of about 30 degrees. Section 31 is preferably a substantially flat planar surface and is slightly larger in area than surface 30, as seen in FIG. 4.

Sides 24 and 28 are similar and therefore only side 24 is described, the description of side 24 also applies to side 28. As seen in FIG. 4, side 24 is divided into two sections 38 and 40. Both sections 38 and 40 are preferably substantially flat planar surfaces and are offset in parallel planes relative to one anther by surface 42. Surface 42 is defined by the intersection of sections 30 and 31 of surface 22.

Figure 5:
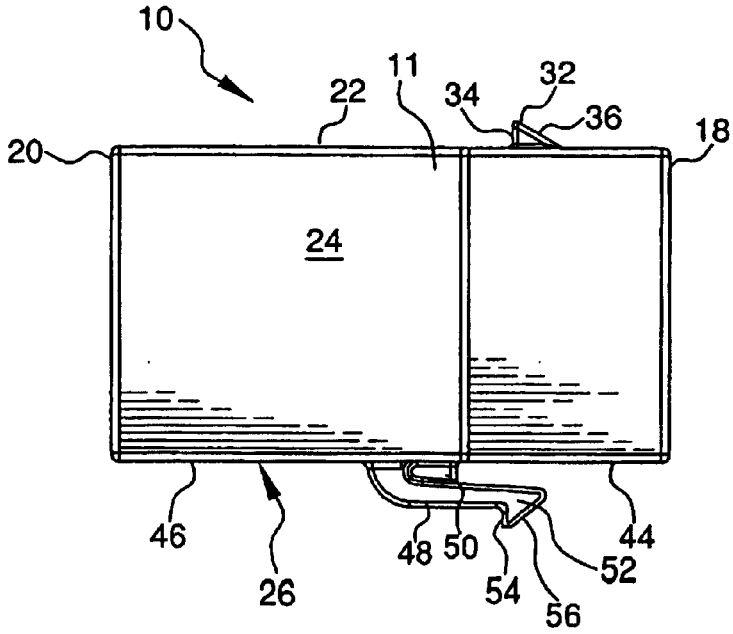
FIG. 5 is an enlarged side elevational view of the adapter of FIG. 2.

Side 26 is substantially similar to surface 22, in that it is divided into two sections 44 and 46, section 46 being slightly larger in surface area than section 44. However, side 26 does not a have protrusion similar to protrusion 32. Rather, side 26 has an arm 48 unitarily formed as one piece with and extending from section 46, as seen in FIG. 5. Arm 48 initially extends substantially perpendicular from section 46 and is about one-half the width of section 46. Arm 48 then curves through a 90° angle toward first end 18. Additionally, arm 48 is supported by a member 50 that is attached to section 46, and terminates with notch or protrusion 52. Protrusion 52 is defined by a surface 54 that extends outwardly and substantially perpendicular to the adjacent portion of arm 48, and a surface 56 that is adjacent to surface 54 that forms an acute included angle of about 60 degrees with surface 54 and terminates at the end of arm 48.

Figure 6:
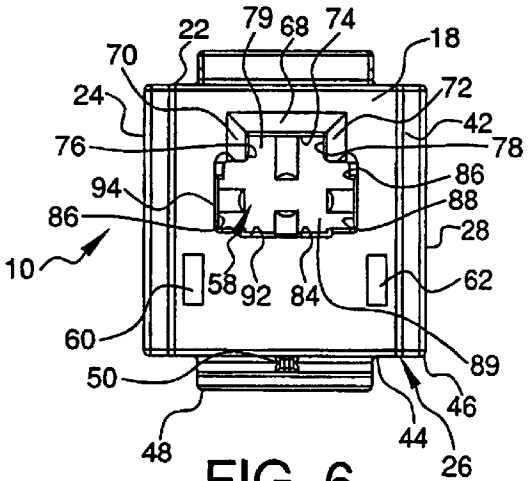
FIG. 6 is an enlarged end elevational view of a first end on the adapter of FIG. 2.

As seen in FIG. 6, first end 18 is preferably rectangular and defines opening 58 therein. Opening 58 is generally rectangular and is preferably a conventional data transmission port for a MT-RJ connector. However, opening 58 may be any size or shape that would allow insertion of a suitable communication or data transmission connector. First end 18 also has openings or icon identification ports 60 and 62. Openings 60 and 62 are preferably rectangular and allow an identification label (not shown) to be inserted therein. The identification label has two fingers that can be inserted into openings 60 and 62 and has a labeling portion extending between the fingers and substantially perpendicular thereto. The finger can be retained in the identification ports by an interference fit.

Figure 7:
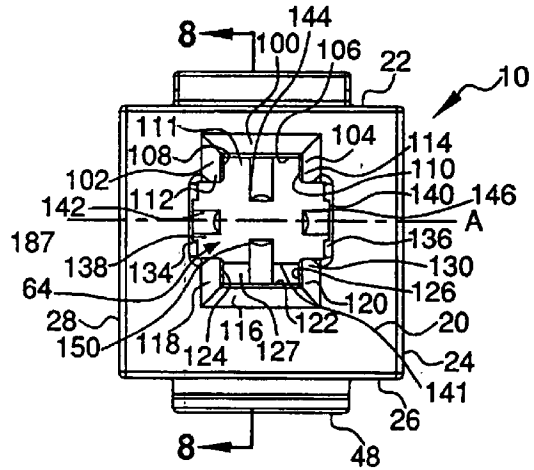
FIG. 7 is an enlarged end elevational view of a second end on the adapter of FIG. 2.

As seen in FIG. 7, second end 20 is preferably rectangular and defines opening 64 therein. Opening 64 is similar to opening 58 in that it is generally rectangular and can receive a conventional MT-RJ connector. However, opening 64 is symmetrical about plane A that includes longitudinal axis y, thus allowing a conventional MT-RJ to be inserted in either a first position or orientation similar to that of plug 12, as seen in FIG. 1, or in a second position or orientation that is preferably angularly offset by approximately 180 degrees about longitudinal axis y of the body 11, as seen in FIG. 2. The orientation of FIG. 1 may be considered the normal or upright orientation, while the orientation of FIG. 2 may be considered the inverted position. However, the second position of body 11 may be offset by any suitable angle that would allow a polarity reversal of the communication or data transmission system.

Figure 9:
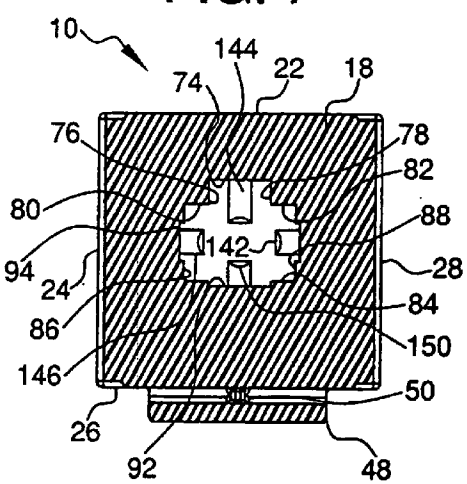
FIG. 9 is an end elevational view in section of the adapter taken along line 9—9 of FIG. 8.
Figure 8:
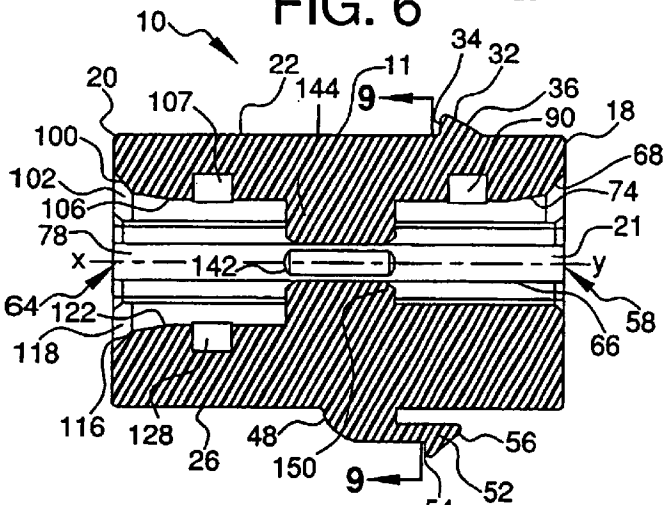
FIG. 8 is a side elevational view in section of the adapter taken along line 8—8 of FIG. 7.

As shown in FIG. 8, first receiving area 66 is adjacent opening 58, and preferably receives a rectangular connector, such as a conventional MT-RJ plug, as seen in FIG. 3. As seen in FIGS. 6 and 8, adjacent opening 58, angled surfaces 68, 70, and 72 extend inwardly toward the center of area 66 to surfaces 74, 76, and 78, respectively. Surfaces 74, 76, and 78 define the substantially rectangular upper portion 79 of area 66, as seen in FIG. 9. Surface 74 has a notch or hole 90 extending upwardly and away from area 66. Surfaces 76 and 78 are substantially perpendicular to surface 74 and result in protrusions 80 and 82.

Also adjacent opening 58 are surfaces 84, 86, and 88 extending inwardly and substantially perpendicular to first end 18. Surfaces 86 and 88 are substantially perpendicular with surface 84 and define along with protrusions 80 and 82, the substantially rectangular lower portion 89 of opening 58. Sides 84, 86 and 88 have grooves 92, 94, and 96, respectively, which allow possible further alignment measures with a male plug or passage of air when not met with a respective key or protrusion on a plug.

As shown in FIG. 8, second receiving area 98 is adjacent opening 64. Second receiving area 98 preferably receives a rectangular connector such as a conventional MT-RJ plug. In receiving area 98, the connector can be received in a normal first position or orientation, similar to receiving area 66, or in an inverted second position or orientation, as seen in FIG. 3. The bottom portion of receiving area 98 is a mirror image about plane A, including longitudinal axis y, of its top portion. As seen in FIGS. 7 and 8, adjacent opening 64, angled surfaces 100, 102, and 104 extend inwardly toward the center of area 98 to surfaces 106, 108, and 110, respectively. Surfaces 106, 108, and 110 define the substantially rectangular upper portion 111 of area 98, as seen in FIG. 7. Surface 106 has a notch or hole 107 extending upwardly and away from area 98. Surfaces 108 and 110 are substantially perpendicular to surface 106, resulting in protrusions 112 and 114.

Adjacent opening 64, angled surfaces 116,118, and 120 extend inwardly toward the center of area 98 to surfaces 122, 124, and 126, respectively. Surfaces 122, 124, and 126 define the substantially rectangular lower portion 127 of area 98, as seen in FIG. 7. Surface 122 has a notch or hole 128 extending downwardly and away from area 98, as seen in FIG. 8. Surfaces 118 and 120 are substantially perpendicular to surface 116 and result in protrusions 130 and 132.

Also adjacent opening 64 are surfaces 134 and 136 extending inwardly and substantially perpendicular to second end 20. The surfaces define, along with protrusions 112, 114, 130, and 132, the substantially rectangular middle portion 137 of area 98. Sides 134 and 136 have grooves 138 and 140, respectively, which allow possible further alignment measures with a male plug or passage of air when not met with a respective key or protrusion on a plug.

As can be seen in FIGS. 7–9, area 66 is slightly smaller than area 98. This discrepancy is due to the expended area for receiving an inverted connector in area 98. The transition from area 98 to area 66 occurs at surface 141 extending substantially perpendicular from surface. 122, specifically shown in FIG. 7. Wall 141 should be equidistant from first and second ends 18 and 20.

Extending between, first receiving area 66 and second receiving area 98 are protrusions 142,146,148 and 150, as shown in FIGS. 6–9. The protrusions are preferably rectangular in longitudinal and lateral cross-section, but may be any suitable shape for aligning jacks that are inserted into the adapter 10. The protrusions extend inwardly and substantially perpendicular from the surfaces defining the first and second receiving areas and toward the center of through passageway 21. The protrusions are aligned in the center of each respective side for aligning the two plugs 12 and 14.

Plugs 12 and 14 are substantially similar, and therefore, only plug 12 is described. Plug 12 is a conventional MT-RJ plug and has a substantially rectangular front portion 152. Front portion 152 is adapted to snugly fit within openings 58 and 64. Molded into front portion 152 are two preferably U-shaped slots 154 that open at the two sides of end 156 of front portion 152, as seen in FIGS. 1 and 2. Slots 154 are adapted to receive protrusions 142, 146, 148 and 150, and are approximately one-half the length of the protrusions. Additionally, front portion 152 has a raised portion 155, with a similar U-shaped portion therein. These dimensions allow two plugs 12 and 14 to receive the protrusions as seen in FIG. 3. Additionally end 152 is open enabling the send and receive optical fibers 153 and 155, respectively, to connect end to end with optical fibers of another plug or connector. The optical fibers are preferably side by side in the plugs 12 and 14, but may be in any position or orientation as long as the abutting jack or plug has the fibers similarly situated.

Plug 12 has a protrusion or hook 156 extending therefrom. The protrusion an unitary part of arm 158 that extends in a direction substantially parallel to front portion 152, as seen in FIGS. 1–3. Connecting the arm to the front portion is stop 160. Stop 160 extends outwardly and substantially perpendicularly from front portion 152 and beyond arm 158. This extended portion or stop 160 abuts first end 18 of the adapter 10 when plug 12 is received therein, as seen in FIG. 3. The optical fibers are inserted through rear end 162 of plug 12 and coupled thereto by any suitable means, such as crimping.

Faceplate 16 is preferably a plastic conventional faceplate, but may be any shape or material that may cover an enclosure, outlet box or box eliminator. Faceplate 16 has apertures 164 extending therethrough, which may number anywhere from one to as many that can be placed in the faceplate. Each aperture 164 is surrounded preferably by a keystone envelope 166 extending therefrom, but the aperture may be any suitable size and shape. Each envelope has a hole or groove 168 in the upper and lower walls 170 and 172, respectively, to engage adapter 10, as seen in FIG. 3.

Assembly

Adapter 10 is inserted into an aperture 164, with protrusion 32 on side 22 engaging groove 168 in wall 170 and with protrusion 52 of arm 48 engaging groove 168 in wall 172, to couple adapter 10 to faceplate 16. Plugs 12 and 14 are then inserted into open ends 18 and 20, with slots 154 receiving protrusions 142, 146, 148, and 150 and with hook 156 engaging notch 90 to secure the plug within the adapter 10. The three U-shaped slots 154 (one on either side and one in protrusion 155) engage three of the protrusions 142, 146 and either 144 or 150, depending on the orientation of the jack in the adapter. The engagement of slots 154 and protrusions 142, 144, 146, and 150 aligns the plugs 12 and 14 so that they abut each other in the adapter and allow the fiber optic cables to meet end to end. The send fibers abut one another and the receive fibers abut one another to allow data transfer from one line to the next. As seen in FIG. 3, plug 12 is received snugly within receiving area 66, the arm 158 of plug 12 entering the upper portion of the area 66 and the front portion 152 entering the lower portion of area 66 with raised portion 155 compensating for the area necessary for inserting arm 158.

If the system is wired improperly, for example, the send fibers matching the receive fibers when the plugs 12 and 14 are inserted in the upright orientation, as in FIG. 1, the plug inserted into the second end 20 may be inverted, as shown in FIGS. 2 and 3. In this instance, the send and receive fibers' positions will be reversed, the polarity of the system will be reversed and the fibers will then match properly, (i.e., the send fibers matching and the receive fibers matching). As seen specifically in FIG. 3 hook 156 will engage notch 128 coupling plug 14 to adapter 10, with the arm 158 of plug 14 entering the lower portion of area 98 and with the front portion 152 of plug 14 entering the middle portion of plug 14. As will be understood by one of ordinary skill in the connector field, by using an adapter of this sort the relative position (which fiber is on the left or the right when observing the fibers in the plug) of the individual fibers is irrelevant. Each individual plug may be wired having the send and receive fibers on either side, and the fibers may be easily matched by inverting the plug, thus reducing installation time and expense.

Embodiment of FIGS. 10–14

Adapter 210 may be inserted into a faceplate as described above and used for a two optical fiber system as described above. However, connector 212 is preferably a conventional connector wherein a transmission line or cable is snapped in either end of the connector and the alignment of the cable is achieved through connector 212. Connector 212 is preferably an SC adapter as is known to one skilled in the art of electrical connectors, but may be any connector for connecting transmission lines.

Figure 12:
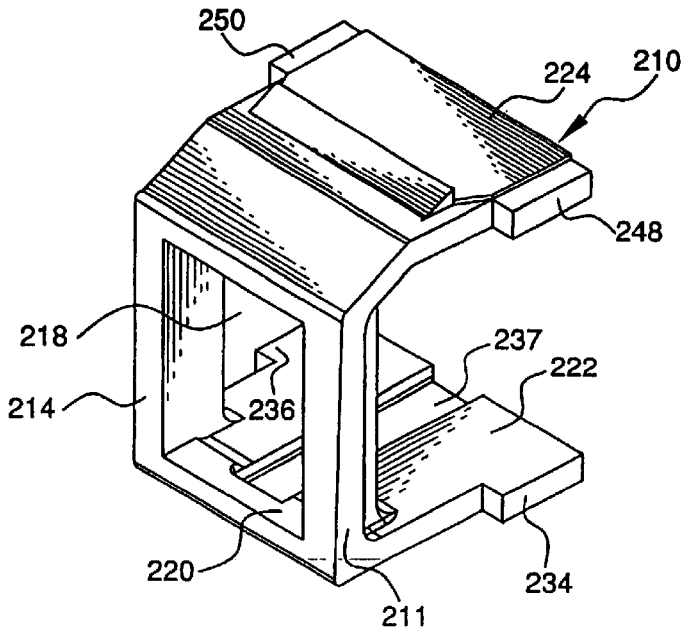
FIG. 12 is a top perspective view of the adapter of FIG. 10.
Figure 13:
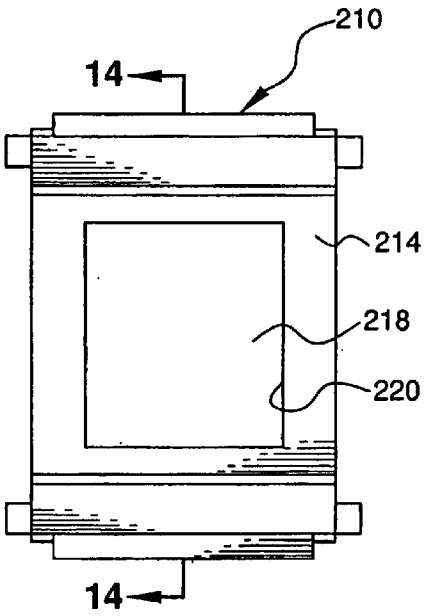
FIG. 13 is an elevational front view of the adapter of FIG. 10.
Figure 14:
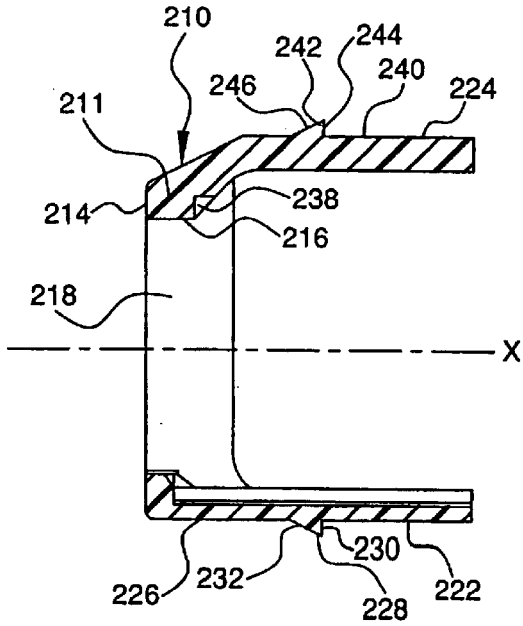
FIG. 14 is a side elevational view in section of the adapter of FIG. 13 taken along lines 14—14.

As seen in FIGS. 12–14, adapter 210 has a body 211 with a longitudinal axis x, a first open end 214 and a second open end 216 coaxial to first open end 214. Ends 214 and 216 are connected by a passageway 218 extending through the body. First end 214 is substantially rectangular having a substantially rectangular opening or aperture 220 therethrough.

Extending from the periphery of second end 216 are resilient arms 222 and 224. Arm 222 extends substantially perpendicular from second end 216 and is approximately the same width as end 216. Arm 222 has a substantially flat planar outer surface 226 with a protrusion 228 extending therefrom. Protrusion 228 is defined by surface 230 that extends outwardly and substantially perpendicularly from surface 226 and a surface 232 that is adjacent surface 230 and extends from surface 226 at an acute included angle, preferably of about 30 degrees. Arm 222 also has extensions 234 and 236 extending substantially perpendicular and laterally from arm 222 and a groove 237. Groove 237 preferably allows clearance for a retention mechanism or spring 254, but can also allow further alignment measures with a plug or passage of air when not met with a respective key or protrusion on a plug.

Arm 224 initially extends at an obtuse angle from second side 216, as seen in FIG. 14, and along with side 216 defines notch 238. Arm 224 then has a slight bend to extend parallel to the longitudinal axis x, terminating arm 224 in a position substantially perpendicular to end 216 and forming a surface 240. Surface 240 has a protrusion 242 extending therefrom and defined by a surface 244 that extends outwardly and substantially perpendicularly from surface 240 and a surface 246 that is adjacent surface 244 and extends from surface 244 at an acute included angle, preferably of about 30 degrees. Arm 224 also has extensions 248 and 250 extending substantially perpendicular and laterally from arm 224.

Figure 10:
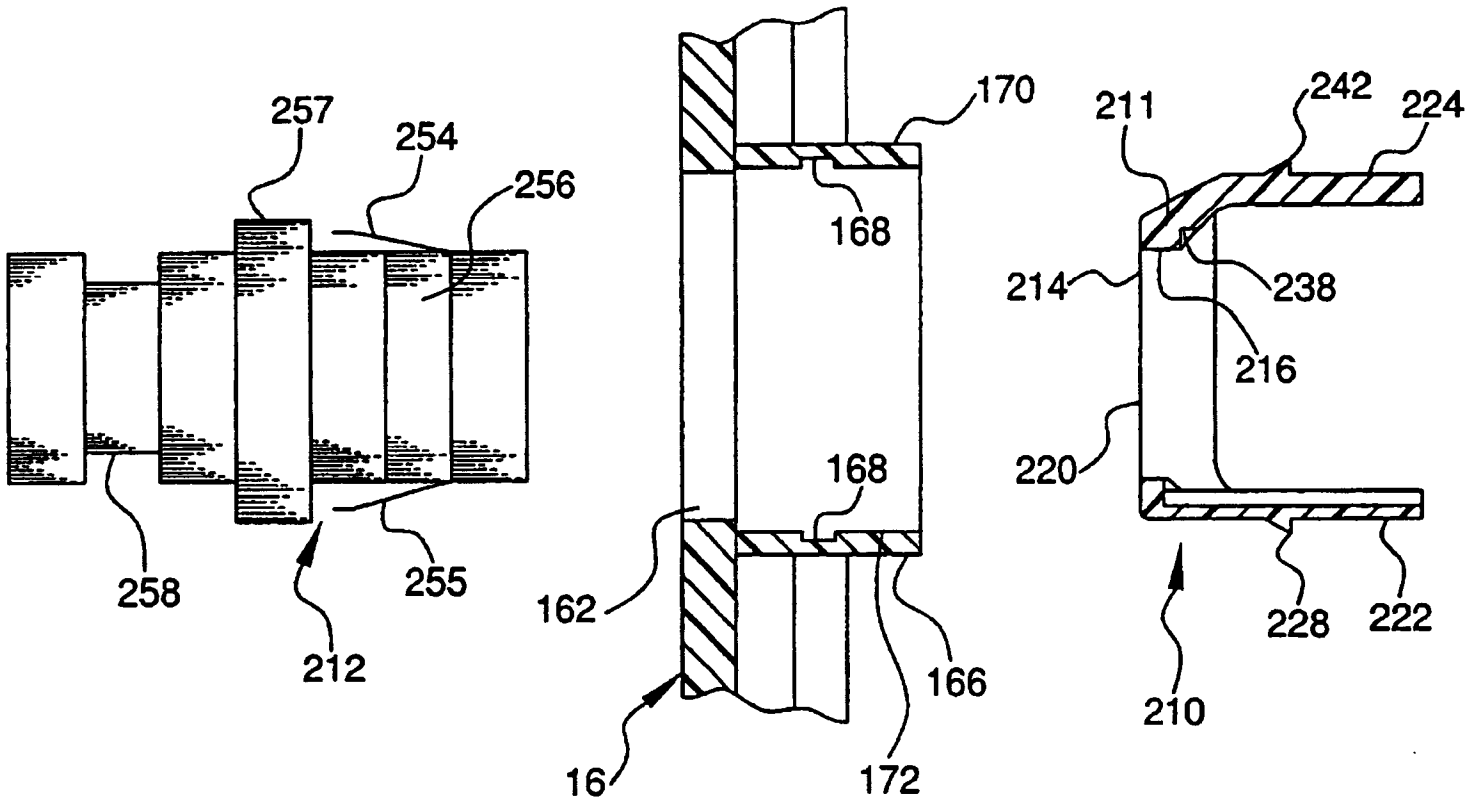
FIG. 10 is an exploded side elevational view in section of an adapter according to a second embodiment of the present invention, prior to engagement with a faceplate and a connector.
Figure 11:
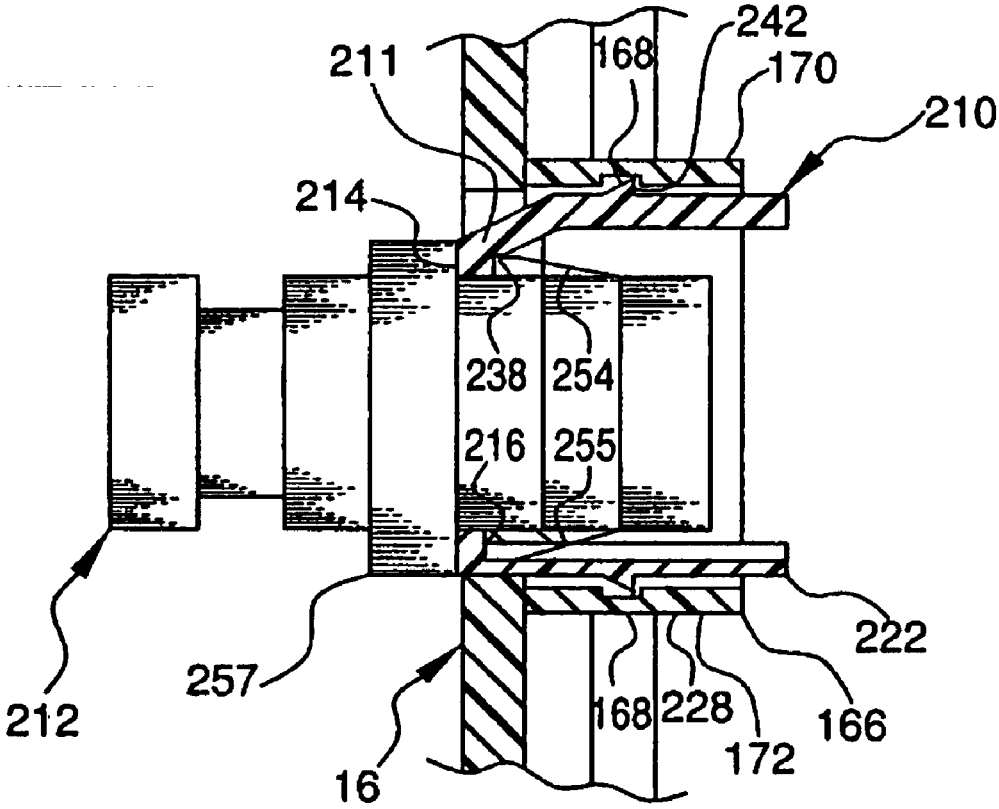
FIG. 11 is a side elevational view in section of the adapter of FIG. 10 engaging the faceplate and the connector.

Connector 212 is preferably rectangular and fits snugly within opening 220. Additionally connector 212 has two metal or plastic springs 254 and 255 coupled thereto, as seen in FIGS. 10 and 11. Springs 254 and 255 attaches to connector 212 by a conventional band 256 that surrounds connector 212 and fits into a groove similar to groove 258. Extending from the center of connector 212 is protrusion 257.

To assemble the adapter system, adapter 210 is inserted into faceplate 16 and protrusions 228 and 248 engage the grooves 168 in the keystone envelop. Connector 212 is then inserted into aperture 220 of adapter 210, with spring 254 engaging notch 238 and spring 254 engaging the corner defined by end 216 and arm 222, and with protrusion 257 abutting faceplate 16, as seen in FIG. 11, to hold connector 212 therein. A fiber optic cable may then be snapped into either end of the connector 212 as is known to one skilled in the art.

Adapter 210 can be easily removed from the keystone envelope in faceplate 16 by applying pressure on surfaces 226 and 240 of arms 222 and 224, respectively. The pressure flexes arms 222 and 224 inwardly and releases notches 228 and 242 from grooves 168. The pressure required may be exerted by hand by an operator without additional tools or implements.

While specific embodiments have been chosen to illustrate the invention, it will be understood by those skilled in the art that various changes and modifications can be made therein without departing from the scope of the invention as defined in the appended claims.

What is claimed is:

1. An adapter for a communication system, comprising:

a body having a longitudinal axis;

a first longitudinal end of said body defining a first opening therein;

a second longitudinal end of said body defining a second opening therein coaxial to said first opening;

a first plug receivable in said first opening; and a second plug receivable in said second opening in at least a first position and a second position, said first position being angular offset relative to said second position about said longitudinal axis of said body;

wherein placement of said second plug in said second position results in a polarity reversal of said system relative to placement of said second plug in said first position.

2. An adapter according to claim 1 wherein said second opening is substantially symmetrical about a plane including said longitudinal axis.

3. An adapter according to claim 2 wherein said second position is offset by 180 degrees relative to said first position about said longitudinal axis.

4. An adapter according to claim 1 wherein said first end has icon identification ports.

5. An adapter according to claim 1 wherein said first opening and said second opening are connected by a passageway extending through said body.

6. An adapter according to claim 1 wherein said first plug abuts said second plug when said first plug is received within said first opening and said second plug is received within said second opening.

7. An adapter according to claim 1 wherein said adapter is received within an aperture in a faceplate.

8. An adapter according to claim 7 wherein said adapter releasasbly engages said faceplate.

9. An adapter according to claim 7 wherein said aperture in said faceplate is a keystone envelope.

10. An adapter according to claim 1 wherein said first and second plugs are MT-RJ type plugs.

11. An adapter according to claim 1 wherein the first plug includes a first optical and a second optical fiber, the first optical fiber sending data and the second optical fiber receiving data.

12. An adapter according to claim 11 wherein the second plug includes a third optical and a fourth optical fiber, the third optical fiber sending data and the fourth optical fiber receiving data.

13. An adapter for a communication system, comprising:

a body having a longitudinal axis;

a first longitudinal end of said body defining a first opening therein;

a second longitudinal end of said body defining a second opening therein coaxial to said first opening, said second opening being substantially symmetrical about a plane including said longitudinal axis;

said first opening and said second opening connected by a passageway extending through said body;

a first plug receivable in said first opening; and a second plug receivable in said second opening in at least a first position and a second position, said second position is offset by 180 degrees relative to said first position about a longitudinal axis;

said first plug abutting said second plug when said first plug is received within said first opening and said second plug is received within said second opening;

wherein placement of said second plug in said second position results in a polarity reversal of said system relative to placement of said second plug in said first position.

14. An adapter according to claim 13 wherein said adapter is received within an aperture in a faceplate.

15. An adapter according to claim 13 wherein said adapter releasably engages said faceplate.

16. An adapter according to claim 15 wherein said aperture is said faceplate is a keystone envelope.

17. An adapter according to claim 13 wherein said first and second plugs are MT-RJ type plugs.

18. An adapter according to claim 13 wherein the first plug includes a first optical and a second optical fiber, the first optical fiber used sending data and the second optical fiber receiving data.

19. An adapter according to claim 18 wherein the second plug includes a third optical and a fourth optical fiber, the third optical fiber sending data and the fourth optical fiber receiving data.

* * * * *